US006107671A

United States Patent [19]

Onodera

[11] Patent Number: 6,107,671

[45] Date of Patent: Aug. 22, 2000

[54] FILM DEVICE PROVIDED WITH A RESISTANCE-ADJUSTABLE RESISTIVE ELEMENT

[75] Inventor: Norio Onodera, Miyagi-ken, Japan

[73] Assignee: Alps Electric Co., Ltd., Tokyo, Japan

[21] Appl. No.: 08/940,356

[22] Filed: Sep. 30, 1997

[30] Foreign Application Priority Data

Oct. 2, 1996 [JP] Japan ..... 8-281489

[51] Int. Cl.[7] ..... H01K 13/70

[52] U.S. Cl. ..... 257/536; 257/537; 257/541; 257/542; 257/543

[58] Field of Search ..... 257/536, 537, 257/541–543

[56] References Cited

U.S. PATENT DOCUMENTS 5,514,842 5/1996 Sugii et al. ..... 200/5 A

*Primary Examiner*—Fetsum Abraham
*Attorney, Agent, or Firm*—Brinks Hofer Gilson & Lione

[57] ABSTRACT

A film device provided with a resistance-adjustable resistive element comprises a base film, a resistive element, a conductive circuit pattern wherein the resistive element is formed on and connected to the conductive circuit pattern, and a corrective layer formed so as to partially cover the resistive element. The resistance of the resistive element is corrected by the corrective layer formed on the resistive element.

9 Claims, 4 Drawing Sheets

FILM DEVICE PROVIDED WITH A RESISTANCE-ADJUSTABLE RESISTIVE ELEMENT

BACKGROUND OF THE INVENTION

1. Field of the Invention

The present invention relates to film devices provided with resistive elements thereon, and in particular, relates to a film device provided with a resistance-adjustable resistive element in which the printed resistive element has a slight variation in resistance.

2. Description of the Related Art

Film device provided with resistance-adjustable resistive elements have been used in control panels for portable telephones, video cameras and the like, and in membrane switches for operating electrical equipment, e.g. washing machines.

In a typical conventional film device provided with a resistan for control panels, as shown in the plan view in FIG. 5, a conductive circuit pattern 2 is printed on a base film 1 composed of a polyester film or the like using a silver paste or the like, and the terminal of the conductive circuit pattern 2 forms a terminal section 2*c* which communicates to external devices. The conductive circuit pattern 2 is provided with a plurality of key switch sections 3, corresponding to, for example, buttons of the portable telephone, each key switch section comprising a pair of contact points 2*a* and 2*b* arranged close to each other. Also, the conductive circuit pattern 2 is provided with a plurality of chip electrical parts 4, e.g. LED, each chip electrical part bridging a pair of terminal sections 2*f*. A resistive element 5 having a resistance of approximately 300 Ω is printed using a carbon paste or the like adjacent to each LED 4. The LED 4 is therefore connected to the terminal section 2*c* through the resistive element 5 which controls the current flow in the LED 4.

A movable contact member composed of a dome-shaped metal blade spring is put on each of key switch sections 3, shown by a broken circle in FIG. 5. When pressing the movable contact member, the two contact points 2*a* and 2*b* are connected or disconnected to each other through the movable contact member for switching operation.

In the operation of the above-mentioned film device provided with a resistance-adjustable resistive element, as shown in the circuit diagram in FIG. 6, a voltage, e.g. 5 volts, is applied to the terminal section 2*c*, which is connected to a terminal section 2*a* of the conductive circuit pattern 2, through a pull-up resistor not shown in the drawing. When the movable contact member of the key switch section 3 is pressed to connect the two contact points 2*a* and 2*b*, the signal of the key switch section 3 is obtained as a change in a voltage level (from a high level to a low level) at the terminal section 2*c* connected to the contact point 2*a*. Further, a constant voltage, e.g. 5 volts, is applied to all the series circuits, each composed of the resistive element 5 and the LED 4, to uniformly illuminate all the key switch sections 3.

The above-mentioned film device provided with a resistance-adjustable resistive element for membrane switches has, as shown in FIGS. 7 and 8, a configuration in which a lower electrode sheet 11 is overlaid with an upper electrode sheet 12 separated by a spacer film 13. The lower electrode sheet 11 comprises a base film composed of a polyester film or the like and a given conductive circuit pattern 2 printed thereon using a silver paste or the like. A portion of the conductive circuit pattern 2 consists of a terminal section 2*c* and a plurality of lower contact points 2*a*, and is provided with a plurality of chip electrical parts, e.g. LEDs 4, and a plurality of resistive elements 5 formed from a carbon paste or the like, in which each LED and each resistive element are connected to the constituent of the conductive circuit pattern 2 in series.

The spacer film 13 is composed of a polyester film or the like and is provided with a plurality of openings 13*a* at positions which correspond to the lower contact points 2*a* and LEDs 4 on the lower electrode sheet 11.

The upper electrode sheet 12 is also formed by printing a conductive circuit pattern 2 and the upper contact point 2*b* on a flexible base film composed of a polyester film or the like using a silver paste or the like, as in the lower electrode sheet 11.

When the film device provided with a resistance-adjustable resistive element is used in severe environments, e.g. washing machines, a protective layer (not shown in the drawing) formed from, for example, carbon ink is provided on the conductive circuit patterns 2 of the upper and lower electrode sheets 12 and 11 excluding the connecting section of each LED 4 and each resistive element 5 in order to prevent circuiting between the conductive patterns 2 due to silver migration.

The upper and lower electrode sheets 12 and 11 are laminated through the spacer film 13 such that the contact points 2*b* and 2*a* and the LED 4 are positioned in their respective openings 13*a* of the spacer film 13. A film device provided with a resistance-adjustable resistive element for membrane switches provided with a plurality of key switch sections 3 at the contact points 2*b* and 2*a* is manufactured in such a manner.

Before use of the film device provided with a resistance-adjustable resistive element, the lower electrode sheet 11 is adhered onto a rigid substrate such as steel sheet in order to maintain its flatness, whereas the upper electrode sheet 12 is covered with a flexible, designed surface sheet 15 which forms an operation surface.

In operation of the film device provided with a resistance-adjustable resistive element, when pressing a given key switch section 3 of the upper electrode sheet 12, the upper electrode sheet 12 is bent and the upper and lower contact points 2*b* and 2*a* at the opening 13 of the spacer film 13 are switched, i.e., connected or disconnected. A constant voltage is applied to all the LEDs 4 to uniformly illuminate all of the key switch section 3 due to light emission from the LEDs. The resistive element 5 restricts the current flow in the LED 4.

The resistive element 5 is formed by printing in all the conventional film device provided with resistance-adjustable resistive elements for control panels and membrane switches. In printing methods, the resistance of the resistive element varies due to variations in the resistance and the thickness of the printed paste, such as a carbon black paste. Although the resistive elements have relatively stable resistances in the same production lot, i.e., variances of ±20%, but has very large variances of ±60% between different lots.

As a result, the brightness of the LEDs 4 varies when the conventional resistive elements 5 are used for controlling the current flowing in the LEDs 4.

All the resistive elements 5 must therefore be inspected to check whether these products satisfy a predetermined resistance range in the production process. Failed products having resistances out of the range cause an increase in cost due to a low yield because the failed products are discarded.

SUMMARY OF THE INVENTION

It is an object of the present invention to provide a film device provided with a resistance-adjustable resistive element which allows low variation in the resistances of the resistive elements and improvement in the yield.

A film device provided with a resistance-adjustable resistive element in accordance with the present invention comprises a base film, a resistive element, a conductive circuit pattern wherein the resistive element is formed on and connected to the conductive circuit pattern, and a corrective layer formed so as to partially cover the resistive element, wherein the resistance of the resistive element is corrected by the corrective layer formed on the resistive element.

An electrical part may be connected to the conductive circuit pattern and the current flow in the electrical part is controlled by the resistive element.

The resistive element may have a meandering configuration, and a portion of the resistive element may be short-circuited with the corrective layer.

An overcoat layer comprising a low resistance material may be formed on the conductive circuit pattern, and the corrective layer may be formed from the overcoat layer.

DESCRIPTION OF THE PREFERRED EMBODIMENTS

Embodiments of a film device provided with a resistance-adjustable resistive element in accordance with the present invention will now be described with reference to FIGS. 1 to 4. The same identification numbers are assigned to the parts having the same functions as in the above-mentioned conventional film device provided with a resistance-adjustable resistive element without duplicated explanation.

Figure 1:
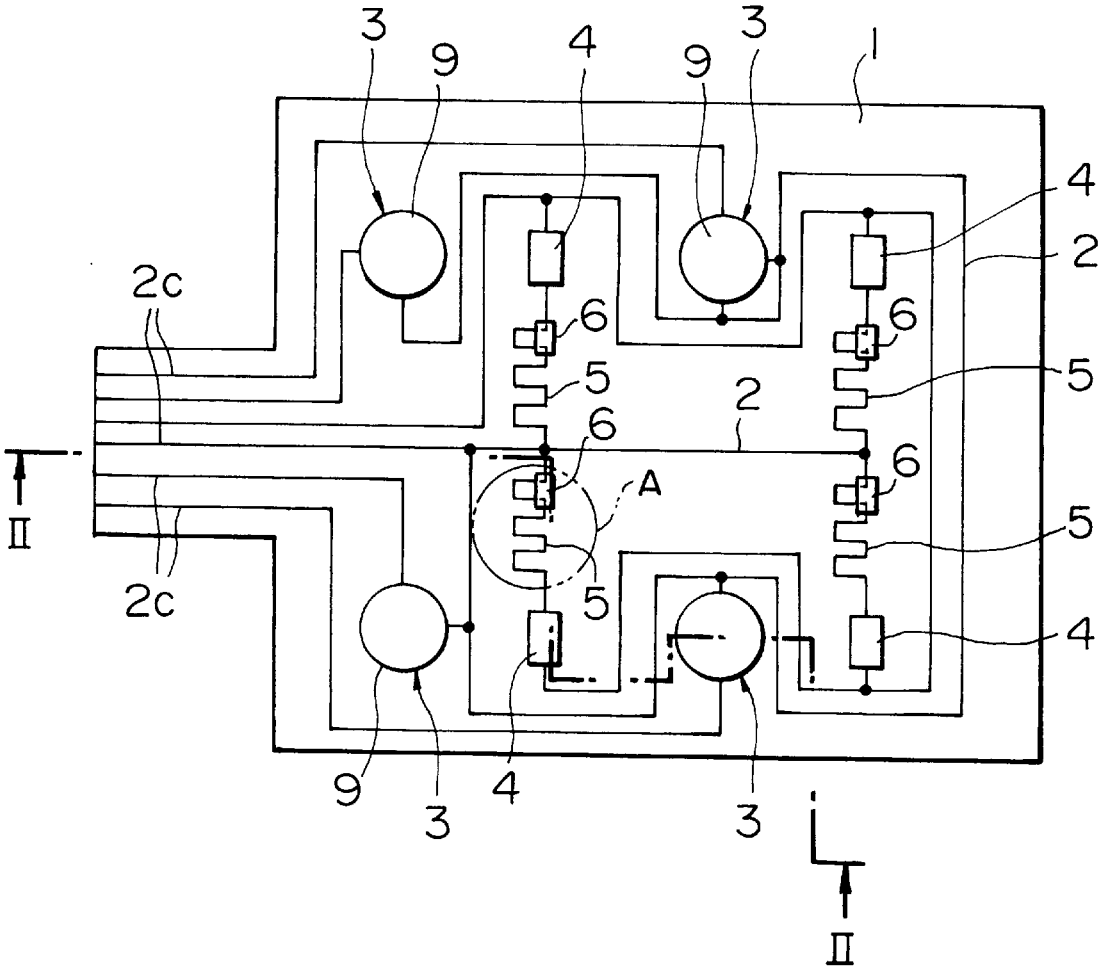
FIG. 1 is a plan view of a film device provided with a resistance-adjustable resistive element applied to a control panel in accordance with the present invention.

FIG. 1 is a plan view of a film device provided with a resistance-adjustable resistive element applied to a control panel as a first embodiment in accordance with the present invention, in which a conductive circuit pattern 2 is printed on a base film 1 composed of, for example, a polyester film, key switch sections 3 and chip electrical parts, e.g. LEDs 4, are connected to given positions of the conductive circuit pattern 2, and a terminal section (connecting section) 2*c* is provided at the terminal of the conductive circuit pattern 2. A resistive element 5 is partially printed between each LED 4 and the conductive circuit pattern 2 to connect them.

In the present invention, each resistive element 5 meanders and has a resistance higher than a final targeted resistance. A corrective layer 6 is printed on a portion of the resistive element 5 using a conductive material. The corrective layer 6 therefore partially short-circuits the resistive element 5, and is capable of correcting the resistance of the resistive element 5 to the final targeted resistance.

Figure 2:
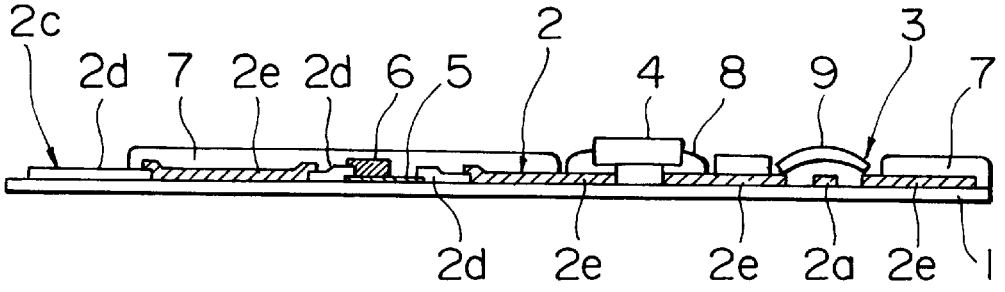
FIG. 2 is a cross-sectional view of a main section taken along sectional line II—II of FIG. 1.

A method for making the film device provided with a resistance-adjustable resistive element will now be described in more detain with reference to FIG. 2 which is a cross-section view of a main section taken along sectional line II—II of FIG. 1. A meandering resistive element 5 is formed by printing a carbon paste on a predetermined position of a base film 1. The resistive element 5 has a film thickness of approximately 10 $\mu$m and a sheet resistance of approximately 1 kΩ/square (corresponding to a specific resistance of approximately 1 Ω·cm at the thickness of 10 $\mu$m). Conductive sections 2*d* having a thickness of approximately 10 $\mu$m and a sheet resistance of approximately 60 mΩ/square (corresponding to a specific resistance of approximately $6\times10^{-5}$ Ω·cm) is formed on both ends of the resistive element 5 and at the terminal section 2*c* using a silver paste. These conductive sections 2*d* form segments of the conductive circuit pattern 2. A predetermined pattern is printed with a mixed ink comprising silver and carbon (hereinafter referred to as a silver-carbon ink) to form wiring sections 2*e* having a thickness of 10 $\mu$m, which forms the residual segments of the conductive circuit pattern 2 and thus is connected to one end of each conductive section 2*d*. The wiring section 2*e* has a sheet resistance of approximately 200 mΩ/square (specific resistance of $2\times10^{-4}$ Ω·cm). The reasons why conductive section 2*d* is formed with a different material to that for the wiring section 2*e* are to secure high strength for connecting with an external terminal and high printing accuracy of the conductive section 2*d*. The inexpensive silver-carbon ink is used for forming the wiring section 2*e* which does not require high printing accuracy. Carbon in the silver-carbon ink can prevent corrosion of silver at the contact points. As suggested in the above resistance, the carbon content is determined so as not to deteriorate conductivity of the conductive circuit pattern 2.

The corrective layer 6 is simultaneously formed with the wiring sections 2*e* using the same silver-carbon ink so as to cover portions of the resistive element 5 and the conductive section 2*d*. In each printing step, the paste or ink is dried on the base film 1 in an oven before the next printing step.

Next, a vinyl-chloride resist layer 7 is formed by printing on the entire base film excluding a portion of the terminal section 2*c*, the connecting section of the LED 4 and the key switching section 3. Finally, the LED 4 is connected to the wiring section 2*e* of the conductive circuit pattern 2 with solder or a silver-based conductive bonding agent 8, and a metallic blade spring 9 is fixed to the key switch section 3 with an adhesive tape or the like not shown in the drawing. The film device provided with a resistance-adjustable resistive element in accordance with the first embodiment of the present invention is produced in such a manner.

Figure 3:
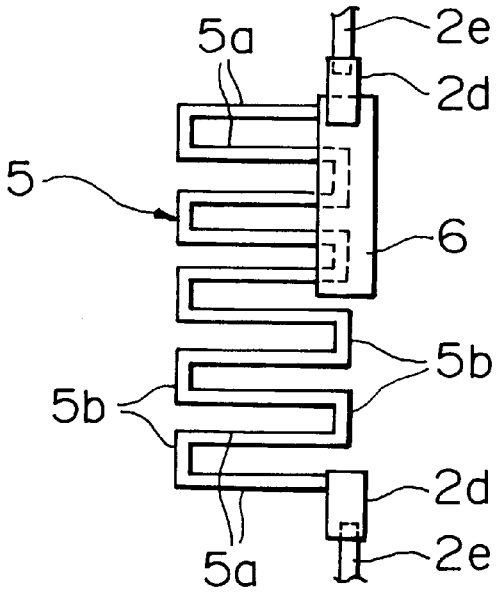
FIG. 3 is an enlarged view of section A in FIG. 1.

Describing adjustment of the resistance of the resistive element 5 with reference to FIG. 3 which is an enlarged view of the section A in FIG. 1, the resistive element 5 in FIG. 3 is composed of, for example, ten straight lines 5*a* and nine turn-up sections 5*b*, and both edges of the resistive element 5 are connected to the wiring sections 2*e* with the conductive sections 2*d*. If the resistive element 5 has an observed resistance of 500 Ω to a targeted resistance of 300 Ω after forming the conductive sections 2*d* and before forming the wiring sections 2*e*, the corrective layer 6 is overlaid on one end of the resistive element 5 and the adjacent two turn-up sections 5*b* to short-circuit the four straight lines 5*a* of the resistive element 5. As a result, the resistive element 5 has a resistance which is the same as the targeted resistance of 300 Ω. The location in which the corrective layer 6 is formed is not limited to the edge of the resistive element 5, and may be on two adjacent middle turn-up sections 5*b* so that the corrective layer 6 short-circuits four straight lines 5*a*. The number of straight lines 5*a* and thus the number of the turn-up sections 5*b* of the meandering resistive element 5 may be determined depending on use. In the meandering resistive element 5, the number of the straight lines 5*a* to be short-circuited for obtaining the targeted resistance can be easily calculated from the resistance and the number of the straight lines 5*a* before correction, resulting in correction of the resistance with high productivity.

Because variations in the resistances of the resistive elements 5 are relatively small in the same production lot as described above, the resistance of a given product is measured to determine a pattern of the corrective layer 6 and the products in the same production lot have almost the same targeted resistance after forming the corrective layer 6 having the determined pattern. By measuring the resistance of one product from every production lot, each product has substantially the same resistance, resulting in improvement in the production yield.

In this embodiment, since the corrective layer 6 and the wiring sections 2*e* of the conductive circuit pattern 2 are simultaneously formed by printing with the same silver-carbon conductive ink, the resistance of the resistive element 5 can be corrected without an additional step. Another resistive material, e.g. a silver paste or a carbon paste, however, is also usable if an additional step is required. The specific resistance of the resistive material is lower than that of the resistive element 5 in order to decrease the final resistance of the resistive element 5 after forming the corrective layer 6 on the resistive element 5. Variation in the corrective layer 6 itself is small relative to that in the resistive element 5 due to its lower resistance.

Another film device provided with a resistance-adjustable resistive element used for a membrane switch will now be described as a second embodiment in accordance with the present invention with reference to FIG. 4 which is a cross-section view of a main section of the film device provided with a resistance-adjustable resistive element. Also, in the second embodiment, a meandering resistive element 5 is printed, and a corrective layer 6 is overlaid on a portion of the resistive element 5 to correct the resistance as in the first embodiment.

The resistive element 5 is printed on a lower electrode sheet 11 using a carbon paste and then a conductive circuit pattern 2 is printed using a silver paste or a silver-carbon ink so as to come into contact with both edges of the resistive element 5. Portions of the conductive circuit pattern 2 form a lower contact point 2*a* and a terminal section 2*c*.

An overcoat layer 10 composed of carbon is formed over the entire conductive circuit pattern 2 excluding the terminal section 2*c*, the resistive element 5 and the connecting sections of an LED 4 in order to prevent corrosion of the silver. The overcoat layer 10 has a sheet resistance of several hundred ohms/square (corresponding to a specific resistance of approximately $10\times10^{-2}$ to $50\times10^{-2}$ Ω·cm at a thickness of 10 μm) lower than that, i.e., approximately 1 Ω·cm, of the resistive element 5. Further, the corrective layer 6 and the overcoat layer 10 are simultaneously formed from the same material. The resistance of the resistive element 5 can be corrected without an additional production or printing step. The overcoat layer 10 formed on the lower contact point 2*a* does not affect digital on/off switching.

The LED 4 is connected to a given position of the conductive circuit pattern 2 with a silver conductive bonding (adhesive) agent 8.

A conductive circuit pattern 2 including an upper contact point 2*b* and an overcoat layer 10 thereon are printed on a flexible upper electrode sheet 12 as in the lower electrode sheet 11, and the lower electrode sheet 11 is overlaid with the upper electrode sheet 12 separated by a spacer film 13 to form a film device provided with a resistance-adjustable resistive element (membrane switch).

The resistance of the resistive element 5 in the second embodiment can be adjusted as in the control panel of the first embodiment, and thus the film device provided with a resistance-adjustable resistive element has a small variation in the resistance.

Figure 4:
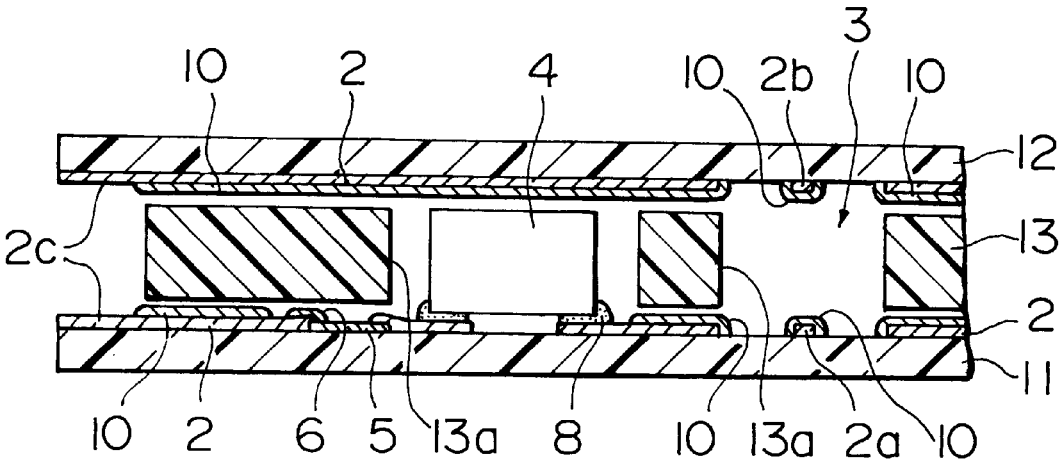
FIG. 4 is a cross-sectional view of a main section of a film device provided with a resistance-adjustable resistive element applied to a membrane switch in accordance with the present invention.
Figure 5:
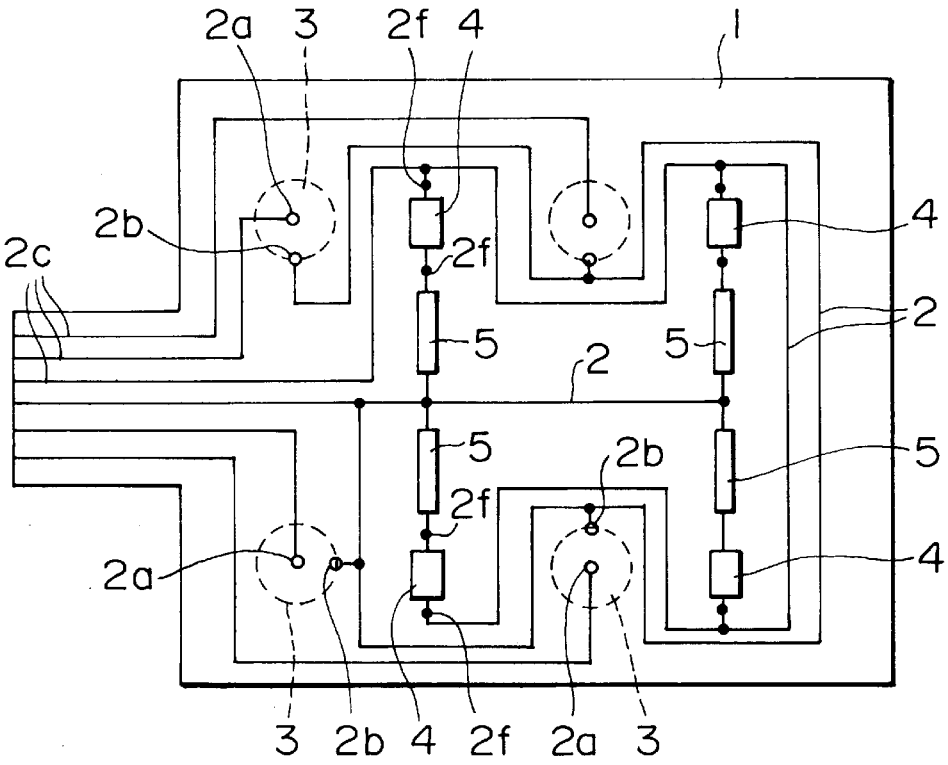
FIG. 5 PRIOR ART
FIG. 5 is a plan view of a conventional film device provided with a resistance-adjustable resistive element for a control panel.
Figure 6:
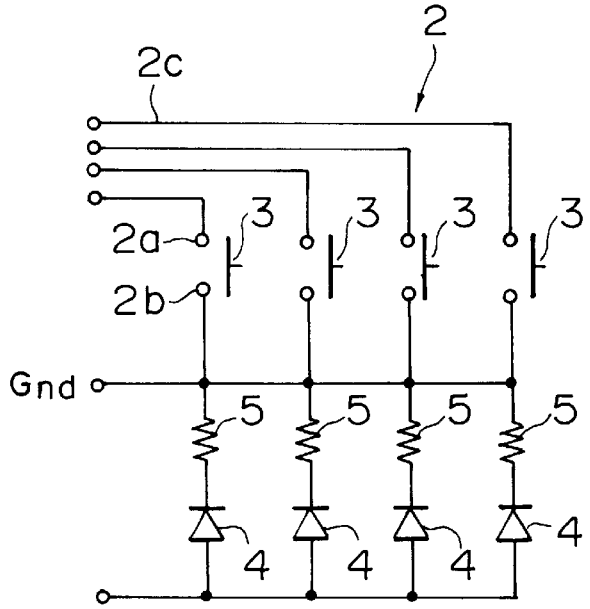
FIG. 6 is a circuit diagram of the film device provided with a resistance-adjustable resistive element in FIG. 1 or FIG. 5.
Figure 7:
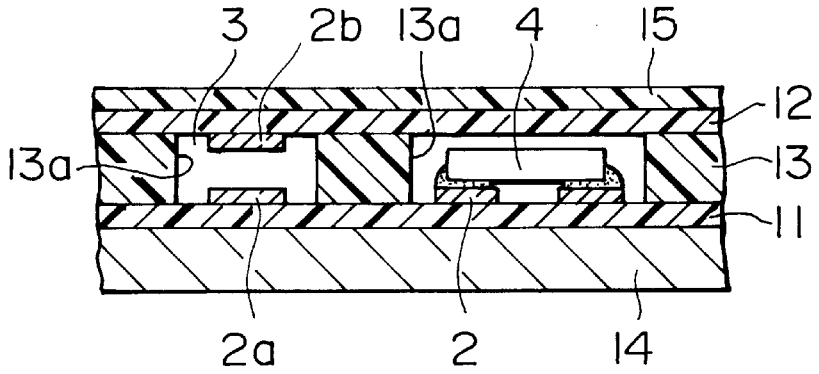
FIG. 7 PRIOR ART
FIG. 7 is a cross-sectional view of a main section of a conventional film device provided with a resistance-adjustable resistive element for a membrane switch.
Figure 8:
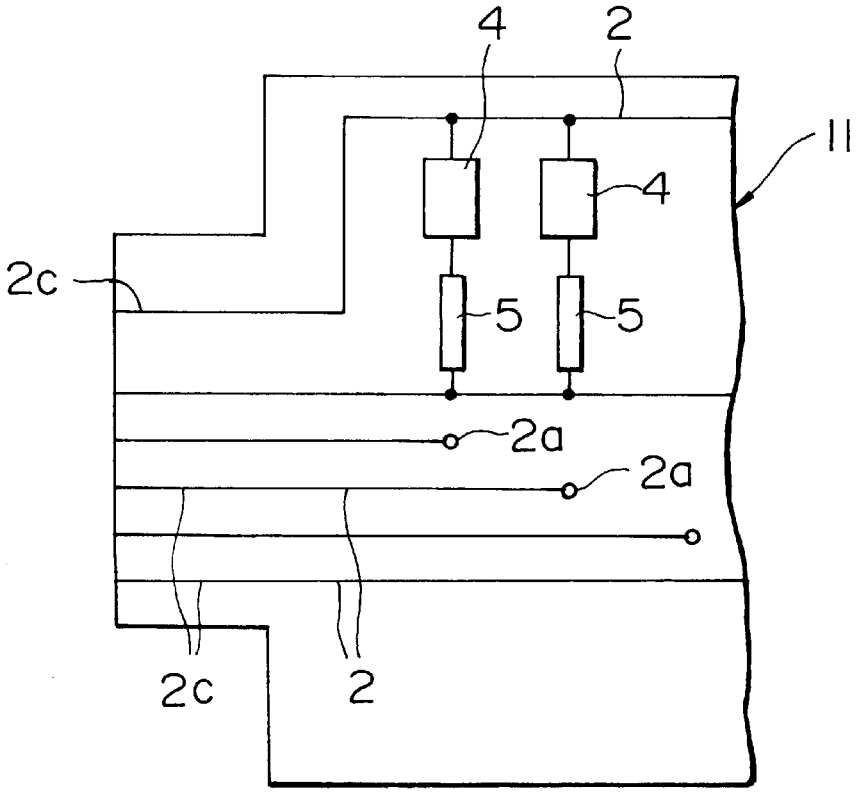
FIG. 8 PRIOR ART
FIG. 8 is a plan view of a main section of a lower electrode sheet of a conventional film device provided with a resistance-adjustable resistive element for a membrane switch.

In FIG. 4, the lower electrode sheet 11, the spacer film 13 and the upper electrode sheet 12 are separated from each other for the purpose of assisting comprehension of the configuration of the membrane switch. Actually, these components are integrated with an adhesive layer (not shown in the drawing).

In the above-mentioned first and second embodiments, the resistance of the resistive element 5 is corrected by the corrective layer 6 printed thereon. Such a correction process can be applied to a plastic base film, such as a polyester film, which does not permit correcting the resistance by laser trimming.

Although the meandering resistive elements 5 in the first and second embodiments are capable of readily correcting their resistances by short-circuiting their straight lines 5*a*, meandering the resistive element 5 is not always essential. The resistance of a straight resistive element 5 can also be corrected by forming a corrective layer 6 on a portion of the resistive element 5. Further, the meandering configuration is not limited to that in FIG. 3, and may be a serrated or corrugated shape.

In the above-mentioned embodiments, each resistive element 5 is used for controlling the current flow in the corresponding LED 4. The resistive element 5 is, however, not limited to such use, and is applicable as a high accuracy resistor having an accurate resistance which is used for severely controlling a current flow or obtaining an accurate analog voltage.

As described above, the film device provided with a resistance-adjustable resistive element in accordance with the present invention comprises a base film, a resistive element, a conductive circuit pattern wherein the resistive element is formed on and connected to the conductive circuit pattern, and a corrective layer formed so as to partially cover the resistive element, and the resistance of the resistive element is corrected by the corrective layer. The resistive element therefore has a small variance in the resistance and thus film device provided with resistance-adjustable resistive elements having uniform properties can be supplied with high yield.

Such a film device provided with a resistance-adjustable resistive element configuration does not need 100% inspection in the production process and thus a reduction in production costs can be achieved.

In the film device provided with a resistance-adjustable resistive element in accordance with the present invention, electrical parts, for example, LEDs are connected to the conductive circuit pattern and a current flow in the electrical part is controlled by the resistive element. Variation in brightness of these LEDs can therefore be reduced, resulting in substantially uniform illumination.

Since the resistive element has a meandering configuration and a portion of the resistive element is short-circuited with the corrective layer in the present invention, the region or pattern of the corrective layer formed on the resistive element can be readily determined in response to the targeted resistance.

Since the corrective layer is composed of a low resistance material or a conductive material which has a specific resistance lower than the resistive element in the present invention, the resistance of the resistive element can be set to a predetermined range by forming a resistive element having a resistance higher than the targeted value and then forming the corrective layer on that resistive element.

In the present invention, the corrective layer is formed from an overcoat layer composed of a low resistance material on the conductive circuit pattern or formed from the same material at least a portion of the conductive circuit pattern. The formation of the corrective layer therefore does not need an additional production step. Accordingly, the resistance of the resistive element can be corrected without adding a further step.

What is claimed is:

1. A film device provided with a resistance-adjustable resistive element comprising a base film, a resistive element, a conductive circuit pattern wherein said resistive element is formed on and connected to said conductive circuit pattern, and a corrective layer formed directly on a surface of the resistive element and formed so as to partially cover said resistive element so that the resistance of said resistive element is corrected by said corrective layer formed on said resistive element.

2. A film device provided with a resistance-adjustable resistive element according to claim 1, wherein an electrical part is connected to said conductive circuit pattern and the current flow in said electrical part is controlled by said resistive element.

3. A film device provided with a resistance-adjustable resistive element according to claim 2, wherein said electrical part comprises a light-emitting diode.

4. A film device provided with a resistance-adjustable resistive element according to claim 1, wherein said corrective layer comprises a resistive material, and a specific resistance of said resistive material is lower than that of said resistive element.

5. A film device provided with a resistance-adjustable resistive element according to claim 4, wherein an overcoat layer comprising a low resistance material is formed on said conductive circuit pattern, and said corrective layer is formed from said overcoat layer.

6. A film device provided with a resistance-adjustable resistive element according to claim 1, wherein said corrective layer is a conductive material.

7. A film device provided with a resistance-adjustable resistive element according to claim 1, wherein said corrective layer is formed from the same material as at least a portion of said conductive circuit pattern.

8. A film device provided with a resistance-adjustable resistive element according to claim 1, wherein said resistive element is a meandering resistive element having a plurality of folded end sections, and the surface of the meandering resistive element is partially covered with the corrective layer.

9. A film device provided with a resistance-adjustable resistive element according to claim 8, wherein the corrective layer short-circuits a predetermined number of adjacent folded end sections arranged in one side of the meandering resistive element.

* * * * *